US012213600B2

(12) United States Patent
Hu et al.

(10) Patent No.: US 12,213,600 B2
(45) Date of Patent: Feb. 4, 2025

(54) CRIB

(71) Applicant: Wonderland Switzerland AG, Steinhausen (CH)

(72) Inventors: JunJie Hu, Steinhausen (CH); I-Ting Yeh, Steinhausen (CH)

(73) Assignee: Wonderland Switzerland AG, Steinhausen (CH)

( * ) Notice: Subject to any disclaimer, the term of this patent is extended or adjusted under 35 U.S.C. 154(b) by 11 days.

(21) Appl. No.: 17/752,878

(22) Filed: May 25, 2022

(65) Prior Publication Data

US 2022/0378221 A1 Dec. 1, 2022

(30) Foreign Application Priority Data

May 26, 2021 (CN) ..... 202110580704.0

(51) Int. Cl.
*A47D 7/01* (2006.01)
*A47C 29/00* (2006.01)

(52) U.S. Cl.
CPC ..... *A47D 7/01* (2013.01); *A47C 29/006* (2013.01)

(58) Field of Classification Search
CPC ..... A47C 1/14; A47C 1/143; A47C 1/146; A47C 29/006
USPC ..... 5/93.1
See application file for complete search history.

(56) References Cited

U.S. PATENT DOCUMENTS

| | | | | |
|---|---|---|---|---|
| 11,185,167 | B1 | 11/2021 | Holland | |
| 2003/0177574 | A1* | 9/2003 | Waldman | A47D 9/016 5/2.1 |
| 2020/0318378 | A1* | 10/2020 | Furuland | A47D 9/005 |

FOREIGN PATENT DOCUMENTS

| | | | | |
|---|---|---|---|---|
| CN | 201504884 | U | 6/2010 | |
| CN | 102396924 | A | 4/2012 | |
| CN | 206687512 | U | 12/2017 | |
| CN | 209750534 | U | 12/2019 | |
| CN | 112806776 | A | 5/2021 | |
| CN | 213138903 | U | 5/2021 | |
| TW | M244822 | U | 10/2004 | |
| WO | WO-2020245713 | A1 * | 12/2020 | A47D 7/02 |

OTHER PUBLICATIONS

Office action mailed/issued on Jan. 31, 2023 for TW application No. 111119190, filing date: May 24, 2022, pp. 1-9.
Office action mailed/issued on Aug. 5, 2024 for CN application No. 202110580704.0, filing date: May 26, 2021, Page(s) 1~9. ,Aug. 5, 2024.

* cited by examiner

*Primary Examiner* — Adam C Ortiz
(74) *Attorney, Agent, or Firm* — Winston Hsu

(57) ABSTRACT

A crib includes a bed body and a sunshade. The bed body includes a bottom plate, two side enclosures located at both ends of the bottom plate, and a first handrail and a second handrail connected to the two side enclosures. The bottom plate, the two side enclosures, the first handrail and the second handrail cooperatively define an accommodating space with an opening. The sunshade includes a frame and a fabric. One end of the frame is movably connected to the first handrail, and the other end of the frame is movably connected to one of the side enclosures. The fabric includes a covering portion covering the frame, and a shielding portion connected among the frame, the first handrail, and the side enclosure.

10 Claims, 8 Drawing Sheets

CRIB

BACKGROUND OF THE INVENTION

1. Field of the Invention

The present disclosure relates to household furniture, in particular to a crib.

2. Description of the Prior Art

In the obstetrics and gynecology department, after a mother has given birth, she and her infant need to be observed in the ward for a period of time before they can be discharged from the hospital. A side enclosure of the common infant crib can be opened. When the infant needs breastfeeding, the mother can place the crib close to an edge of her bed, then open the side enclosure of the crib, and carry the infant to her side for breastfeeding. The newborn's eyes cannot be subjected to direct light. However, the lamps in the ward are arranged on the roof and the light is oriented downward, which may cause excessive stimulation to the newborn's eyes. Therefore, a sunshade and other mechanisms are needed to protect the newborn's eyes. However, the conventional sunshade is difficult to be connected to and mounted on the crib conveniently and efficiently.

SUMMARY OF THE INVENTION

According to various embodiments, a crib is provided.

A crib includes a bed body and a sunshade. The bed body includes a bottom plate, two side enclosures located at both ends of the bottom plate, and a first handrail and a second handrail connected to the two side enclosures. The bottom plate, the two side enclosures, the first handrail and the second handrail cooperatively define an accommodating space with an opening. The sunshade includes a frame and a fabric. One end of the frame is movably connected to the first handrail, and the other end of the frame is movably connected to one of the side enclosures. The fabric includes a covering portion covering the frame, and a shielding portion connected among the frame, the first handrail, and the side enclosure.

The details of one or more embodiments of the present disclosure are set forth in the accompanying drawings and the description below. Other features, objects and advantages of the present disclosure will become apparent from the description, drawings and claims.

These and other objectives of the present invention will no doubt become obvious to those of ordinary skill in the art after reading the following detailed description of the preferred embodiment that is illustrated in the various figures and drawings.

DETAILED DESCRIPTION

In order to make the aforementioned objects, features and advantages of the present disclosure more clearly understood, the specific embodiments of the present disclosure will be described in detail below with reference to the accompanying drawings. In the following description, numerous specific details are set forth in order to provide a thorough understanding of the present disclosure. However, the present disclosure can be implemented in many other ways different from those described herein, and those skilled in the art can make similar improvements without departing from the connotation of the present disclosure. Therefore, the present disclosure is not limited by the specific embodiments disclosed below.

It should be understood that when an element is defined as "fixed to" another element, it is either directly on an element or indirectly on an element with a mediating element. When an element is considered to be "connected" to another element, it can be directly connected to another element or indirectly connected to another element with a mediating element.

Unless otherwise defined, all technical and scientific terms used herein have the same meaning as commonly understood by one of ordinary skill in the technical field to which the present disclosure belongs. The terms used herein in the specification of the present disclosure are for the purpose of describing specific embodiments only, and are not intended to limit the present disclosure. The term "and/or" used herein includes any and all combinations of one or more of the associated listed items.

Figure 1:
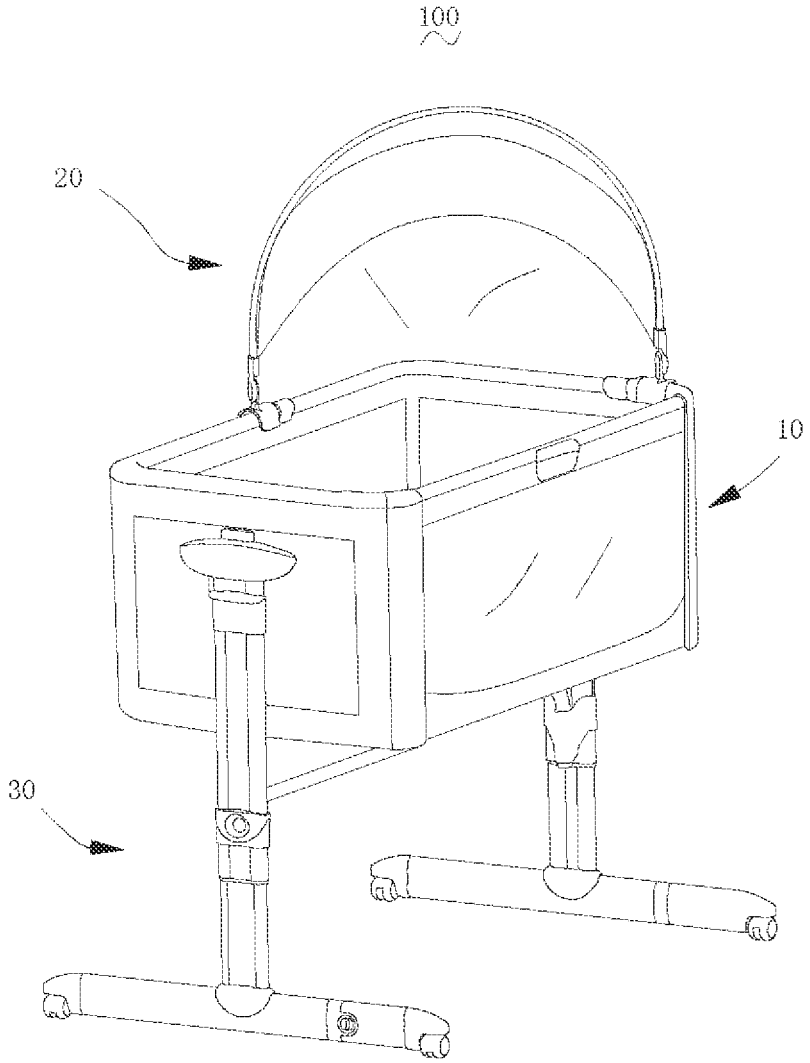
FIG. 1 is a perspective view of a crib according to an embodiment.

Referring to FIG. 1, a crib 100 according to an embodiment mainly includes a bed body 10, a sunshade 20, and a supporting device 30. The sunshade 20 is mounted on the bed body 10, which can prevent the ambient light from directly irradiating on an infant and interfering the infant's sleep. The supporting device 30 is located below the bed body 10 and is configured to support the bed body 10.

Figure 2:
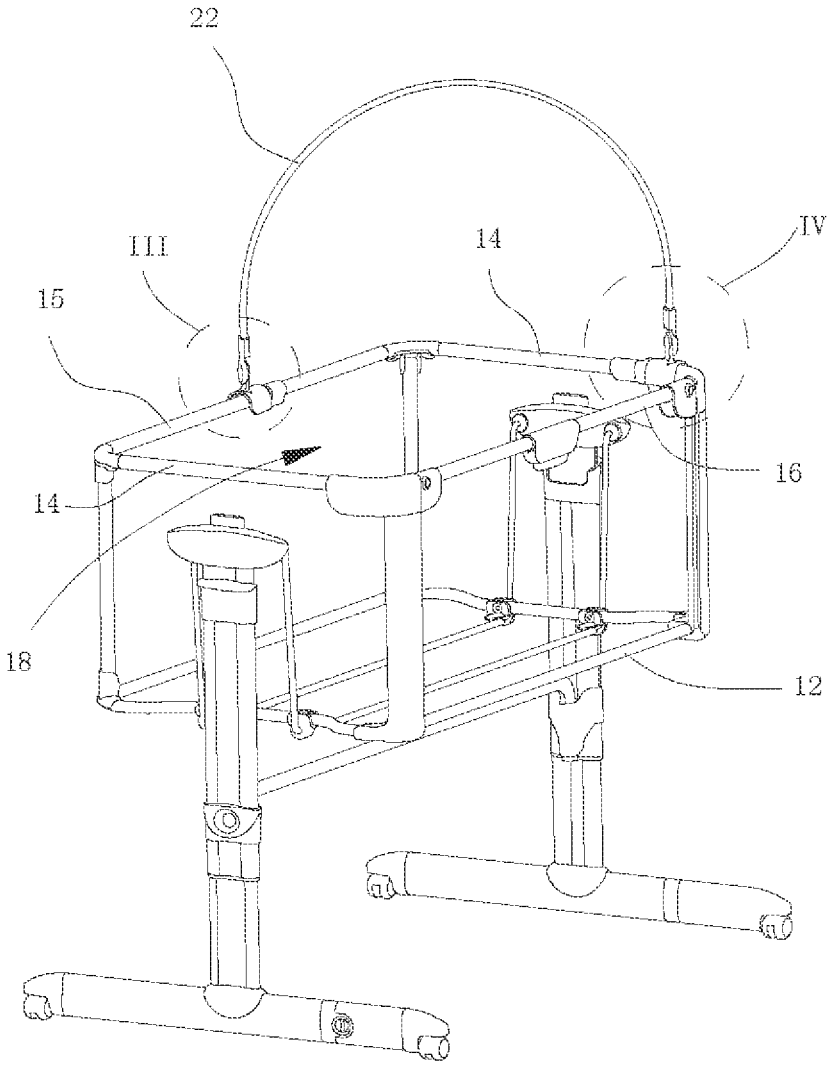
FIG. 2 is a perspective view of the crib shown in FIG. 1 after removing a seat cloth.

Referring also to FIG. 2, the bed body 10 generally includes a bottom plate 12, two side enclosures 14, and two handrails. The bottom plate 12 is substantially rectangular and is configured to carry the infant. Mattresses, sheets, pillows and other bedclothes can be placed on the bottom plate 12. Two substantially rectangular side enclosures 14 extend upward from both ends of the bottom plate 12, respectively. The two handrails include a first handrail 15 and a second handrail 16 that are substantially parallel to each other. Both ends of the first handrail 15 are respectively connected to one end portions of the two side enclosures 14 and are located at a rear side of the bed body 10. Both ends of the second handrail 16 are movably connected to the other end portions of the two side enclosures 14 respectively, and are located on a front side of the bed body 10. The bottom plate 12, the two side enclosures 14, the first handrail 15, and the second handrail 16 cooperatively define an accommodating space with an opening 18 on the top. The infant can enter the accommodating space through the opening 18 and play in the accommodating space.

As shown in FIG. 1, the bottom plate 12, the two side enclosures 14, the first handrail 15, and the second handrail 16 are covered with a seat cloth formed of a soft material to provide a good touch feeling. A translucent gauze is also provided between the first handrail 15 and the bottom plate 12, and the second handrail 16, and the bottom plate 12.

As shown in FIGS. 1 to 4, the sunshade 20 includes a frame 22, a fabric 24, and two engaging members 26 and 28. The frame 22 is substantially a semicircular elongated rod, one end of the frame 22 is movably connected to the first handrail 15 via the first engaging member 26, and the other end thereof is movably connected to the side enclosure 14 via the second engaging member 28.

Figure 3:
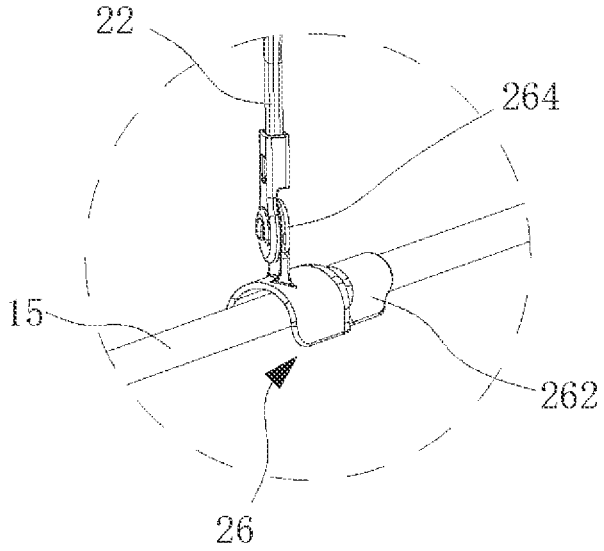
FIG. 3 is a partial enlarged view of a portion III in FIG. 2.

Referring to FIG. 3, the first engaging member 26 includes an engaging portion 262 having a substantially C-shaped cross-section and a pivoting portion 264 protruding from a top portion of the engaging portion 262. The engaging portion 262 is made of an elastic material, such as metal or engineering plastic. The engaging portion 262 has an engaging slot matched with the first handrail 15, such that the engaging portion 262 is capable of elastically engaging with the first handrail 15 and can be easily detached from the first handrail 15. The pivoting portion 264 is provided with a pivoting hole, and an end portion of the frame 22 is provided with a shaft hole. A screw extends through the pivot hole and the shaft hole, such that an end portion of the frame 22 is hinged to the pivoting portion 264.

Figure 4:
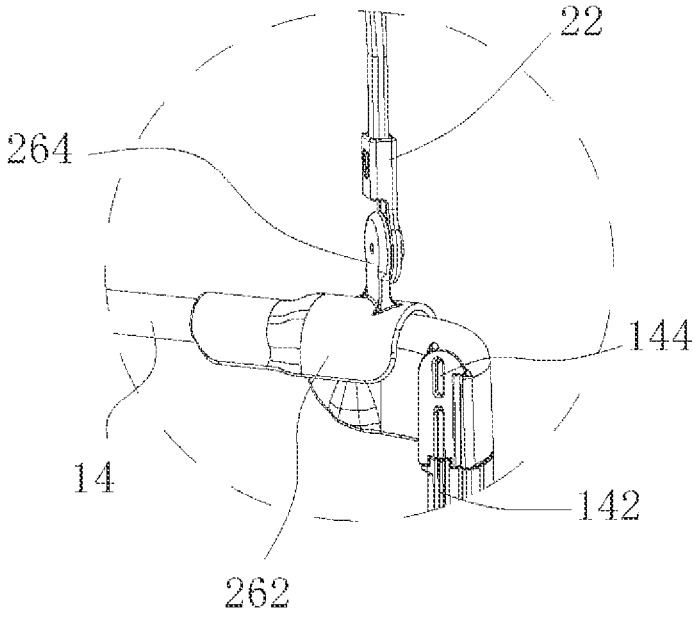
FIG. 4 is a partial enlarged view of a portion IV in FIG. 2.

Referring to FIG. 4, the second engaging member 28 has basically the same structure as that of the first engaging member 26, which includes an engaging portion 282 having a substantially C-shaped cross-section and a pivot portion 284 extending upward from a top edge of the engaging portion 282. The engaging portion 282 is made of an elastic material, such as metal or engineering plastic. The engaging portion 282 has an engaging slot matched with the side enclosure 14, such that it can elastically engage with the side enclosure 14, and can be easily detached from the side enclosure 14.

The pivoting portion 284 is provided with a pivoting hole, and the other end of the frame 22 is provided with a shaft hole. A screw extends through the pivot hole and the shaft hole, such that the other end portion of the frame 22 is hinged to the pivoting portion 284.

Figure 5:
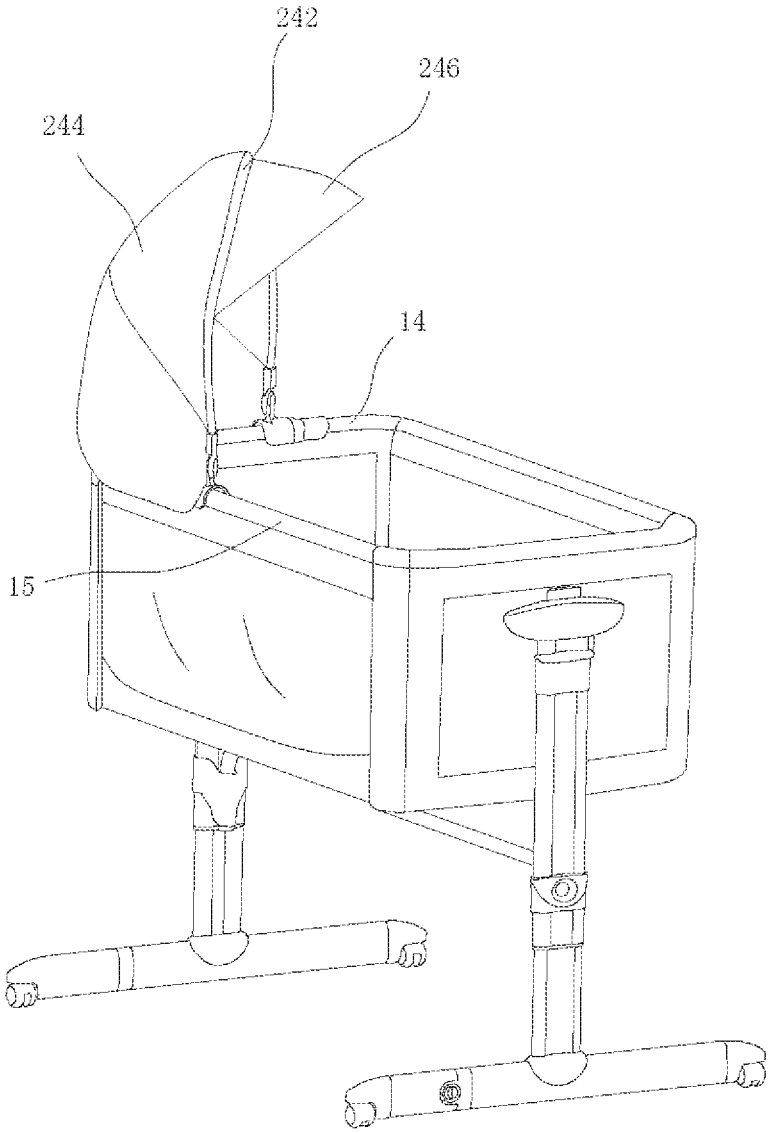
FIG. 5 is a perspective view of the crib shown in FIG. 1 in another aspect.
Figure 6:
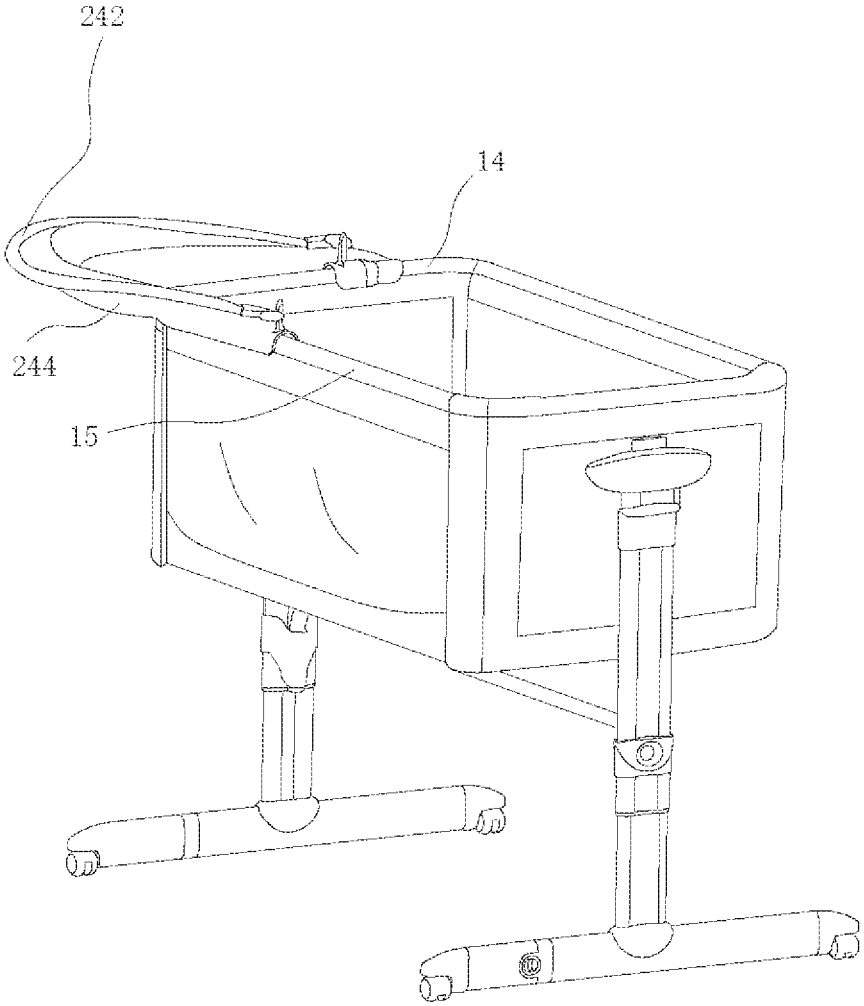
FIG. 6 shows a state where a sunshade of the crib in FIG. 5 is folded.

Since both ends of the frame 22 are hinged to the first handrail 15 and the side enclosure 14, respectively, the frame 22 is capable of performing a pitching motion relative to a plane where the opening 18 is located, as shown in FIG. 5 and FIG. 6. It should be noted that a height or a length of the frame 22 needs to be designed to satisfy that the frame 22 does not interfere with a junction between the first handrail 15 and the side enclosure 14 when the frame 22 rotates to be parallel to the plane where the opening 18 is located.

Referring to FIG. 1 and FIG. 5 together, the fabric 24 is formed of seat cloth or other soft materials to facilitate folding and storage. The fabric 24 includes a covering portion 242, a shielding portion 244, and an edge portion 246. The covering portion 242 is wrapped around the frame 22. The shielding portion 244 extends backward from the covering portion 242 until the shielding portion 244 is in contact with the first handrail 15 and the side enclosure 14, thereby forming a complete light-shielding region to prevent light from passing through gaps between the fabric 24 and the first handrail 15, and between the fabric 24 and the side enclosure 14. In this embodiment, the shielding portion 244 is also configured to accommodate a mosquito net 40. The edge portion 246 extends forward from the covering portion 242 to form a shape similar to a brim of a hat, thereby further expanding the light-shielding region. The edge portion 246 can also support the mosquito net 40 to increase a space when the mosquito net 40 is deployed.

Figure 7:
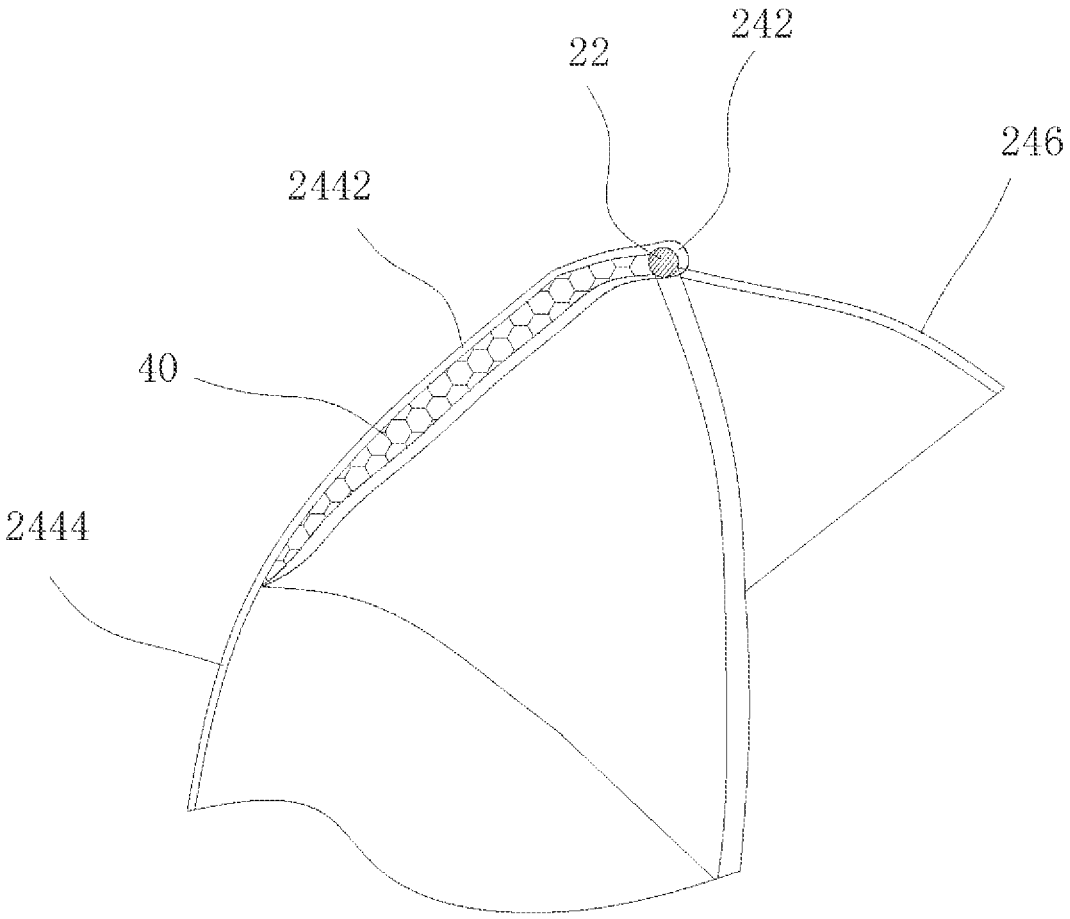
FIG. 7 is a cross-section view of the sunshade in FIG. 5.

Referring to FIG. 7, the shielding portion 244 further includes a first shielding portion 2442 and a second shielding portion 2444 that are connected to each other. The first shielding portion 2442 is connected to the covering portion 242, and the second shielding portion 2444 is connected to the first handrail 15 and the side enclosure 14. The first shielding portion 2442 may be of a double-layers structure, which forms an accommodating cavity therein configured to accommodate the mosquito net 40. An elongated slit is provided on the outer side of the covering portion 242 to facilitate the mosquito net 40 to enter or be taken out from the accommodating cavity. After the mosquito net 40 is completely located in the accommodating cavity, in order to stably fix the mosquito net 40 in the accommodating cavity, and to prevent the mosquito net 40 from being exposed from the slit, a zipper may be provided on the slit. In other embodiments, sealing mechanisms such as HOOK & LOOP, magnetic strips, buttons, etc. can also be employed to open or close the slit.

Figure 8:
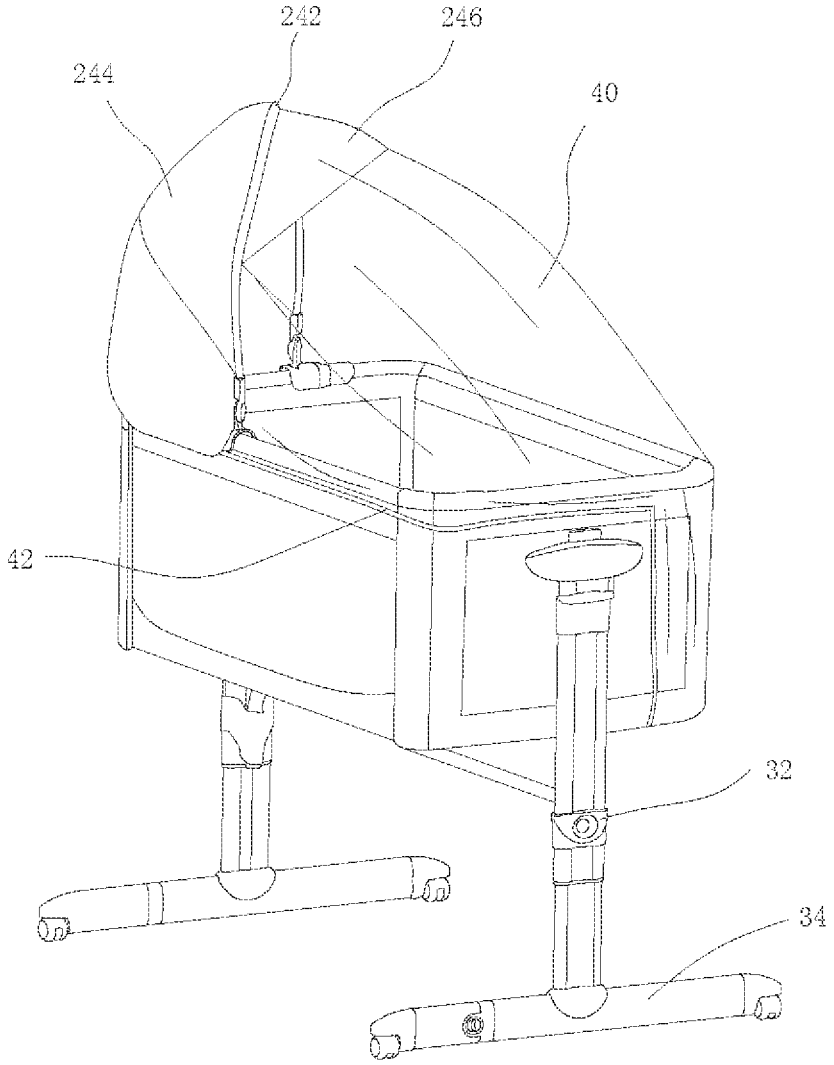
FIG. 8 shows a state where a mosquito net of the crib in FIG. 5 is deployed.
Figure 9:
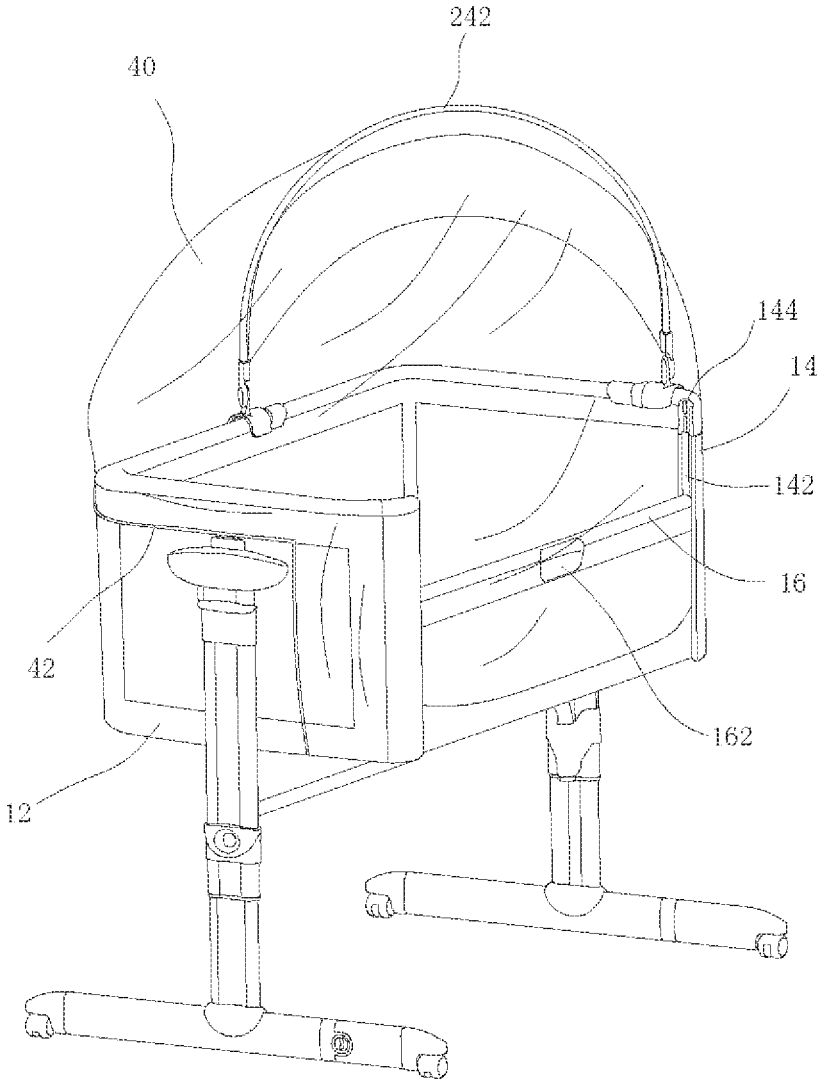
FIG. 9 is a perspective view of FIG. 8 from another aspect.

Referring to FIG. 8 and FIG. 9, the mosquito net 40 is made of cotton yarn or chemical fiber. The mosquito net 40 can be switched between a first state accommodated in the first shielding portion 2442 and a second state covering the opening 18. In the first state, the mosquito net 40 is normally folded and stored in the accommodating cavity of the first shielding portion 2442. When the mosquito net 40 needs to be used, the zipper can be opened first, then one end of the mosquito net 40 can be pulled out from the slit, and then covers the opening 18 of the bed body 10, so as to prevent mosquitoes from harming the infant. Since the mosquito net 40 is very light in weight, in order to ensure that the mosquito net 40 covering the opening 18 will not be easily blown off by the wind, the edge of the mosquito net 40 is also provided with an elastic band 42. The elastic band 42 can tightly wrap around the opening 18, such that the mosquito net 40 can cover the opening 18 more stably. In other embodiments, the mosquito net 40 can also be detachably fixed on the opening 18 by means of velcros, buttons, zippers, magnet pieces, and the like.

When the mosquito net 40 is no longer needed, the mosquito net 40 can be removed from the opening 18, folded, and then stuffed back into the accommodating cavity. At this time, all of the mosquito nets 40 are hidden in the first shielding portion 2442, the mosquito net 40 cannot be observed from the outside, and the appearance is very neat. It should be understood that the mosquito net 40 can also be completely taken out from the accommodating cavity of the first shielding portion 2442 for cleaning or replacement. When the sunshade 20 is no longer needed, the first engaging member 26 can also be separated from the first handrail 15, and the second engaging member 28 can be separated from the side enclosure 14, such that the whole sunshade 20 can be easily separated from the bed body 10.

Referring to FIGS. 1 and 9, in this embodiment, the second handrail 16 can also slide in a vertical direction relative to the two side enclosures 14, that is, the second handrail 16 can be raised or lowered relative to the bottom plate 12 by a predetermined distance. As shown in FIGS. 4 and 9, the side enclosure 14 is provided with a slideway 142 extending in the vertical direction. A top portion of the side enclosure 14 is further provided with a positioning hole 144 spaced from the slideway 142. Both ends of the second handrail 16 are provided with retractable positioning pieces (not shown). A middle portion of the second handrail 16 is further provided with an operating member 162. The operating member 162 is linked with the positioning piece, that is, when the operating member 162 is pressed, the positioning piece can be driven to extend out or retract from holes at both ends of the second handrail 16. In a normal state, the positioning pieces protrude from both ends of the second handrail 16 and engage in the positioning holes 144 of the side enclosure 14 to realize relative positioning of the second handrail 16 and the side enclosure 14. When the second handrail 16 needs to be lowered to a certain height, the operating member 162 can be pressed to drive the positioning piece to retract, that is, to disengage it from the positioning hole 144. At this time, a height of the second handrail 16 can be lowered by pressing the second handrail 16 downward. After releasing the pressing operating member 162, the positioning pieces can protrude from both ends of the second handrail 16 again and enter the slideway 142 of the side enclosure 14. Since the positioning pieces can slide in the slideway 142, the second handrail 16 can be lowered to a certain height, which is convenient for the user to enter the accommodating space from a side surface of the bed body 10 to acquire items. In addition, the crib 100 can be placed close to an adult bed. When the infant cries at night, since the second handrail 16 can be lowered to a certain height, the mother can put her hand into the crib 100 from one side of the second handrail 16 to comfort the infant without removing the mosquito net 40 from the opening 18, thus preventing mosquitoes from entering the crib 100.

When the second handrail 16 needs to be restored, the second handrail 16 can be pushed upwards with force until the positioning pieces cross over a spacer strip between the slideway 142 and the positioning hole 144 and enters the positioning hole 144. Since a shape of the positioning hole 144 matches that of the positioning pieces, the second handrail 16 can be restored to the original state of being aligned with the top portion of the side enclosure 14. It should be understood that, in order to ensure that the positioning pieces cross over the spacer strips more smoothly, the positioning pieces may also be provided with inclined contact surfaces.

In some embodiments, the side enclosure 14 connecting both ends of the second handrail 16 is further made of flexible material. When the second handrail 16 is lowered, the side enclosure 14 connecting both ends of the second handrail 16 can also be bent by about 90 degrees, so as to extend a lower end of the second handrail 16 to the bottom plate 12.

Referring to FIGS. 1 and 8, in this embodiment, the supporting device 30 includes a lifting device 32 connected to the bed body 10 and a supporting leg 34 located at a bottom portion of the lifting device 32. The lifting device 22 can be configured to adjust a height of the bed body 10 relative to the ground to adapt to adult beds of various heights. In one embodiment, a self-locking universal wheel 36 is further mounted on a lower end of the supporting leg 34 to facilitate the movement and positioning of the bed body 10.

The sunshade 20 of the crib 100 includes the frame 22, one end of the frame 22 is movably connected to the first handrail 15, and the other end of the frame 22 is movably connected to one of the side enclosures 14, such that the frame 22 is capable of performing pitching motion relative to the plane where the opening 18 is located. In addition, the fabric 24 of the sunshade 20 can play the role of light shading and sun protection, and can further protect the eyesight of the newborn.

The technical features of the aforementioned embodiments may be combined arbitrarily. To simplify the description, not all the possible combinations of the technical features in the above embodiments are described. However, all of the combinations of these technical features should be considered as within the scope of the present disclosure, as long as such combinations do not contradict with each other.

The above embodiments only represent several examples of the present invention, and the description thereof is more specific and detailed, but it should not be construed as restricting the scope of the present invention. It should be noted that, for those skilled in the art, several variations and improvements may be made without departing from the concept of the present invention, and these are all within the protection scope of the present invention. Therefore, the protection scope of this invention shall be defined by the appended claims.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A crib, comprising:

a bed body comprising a bottom plate, two side enclosures located at opposite ends of the bottom plate, and a first handrail and a second handrail that are oppositely arranged and connected to the two side enclosures, both ends of the first handrail being directly connected to one end portions of the two side enclosures respectively, both ends of the second handrail being directly movably connected to other end portions of the two side enclosures respectively, wherein the bottom plate, the two side enclosures, the first handrail, and the second handrail cooperatively define an accommodating space with an opening; and a sunshade comprising:

a frame, wherein one end of the frame is movably connected to the first handrail, and a second end of the frame is movably connected to one of the side enclosures; and a fabric comprising a covering portion covering the frame, and a shielding portion connected among the frame, the first handrail, and the side enclosure.

2. The crib of claim 1, further comprising a mosquito net switchable between a first state accommodated in the shielding portion and a second state covering the opening.

3. The crib of claim 2, wherein the shielding portion comprises a first shielding portion connected to the covering portion and a second shielding portion connected to the first handrail and the side enclosure, the first shielding portion forms an accommodating cavity configured to accommodate the mosquito net therein, a slit is further formed on the covering portion, and the mosquito net is capable of passing through the slit to cover the opening.

4. The crib of claim 3, wherein the covering portion is provided with a zipper configured to open or close the slit.

5. The crib of claim 1, wherein an edge of a mosquito net is provided with an elastic band capable of wrapping around the opening.

6. The crib of claim 1, further comprising a first engaging member detachably mounted on the first handrail and a second engaging member detachably mounted on the side enclosure, wherein both ends of the frame are hinged to the first engaging member and the second engaging member, respectively.

7. The crib of claim 1, wherein the second handrail is capable of being raised or lowered by a predetermined distance relative to the bottom plate.

8. The crib of claim 7, wherein the side enclosure is provided with a slideway extending in a vertical direction, and both ends of the second handrail are provided with positioning pieces capable of sliding in the slideway.

9. The crib of claim 8, wherein a top portion of the side enclosure is further provided with a positioning hole corresponding to the positioning piece, the positioning hole is spaced apart from the slideway, the crib further comprises an operating member provided on the second handrail, and the operating member is pressed to drive the positioning piece to enter the positioning hole or move out of the positioning hole.

10. The crib of claim 1, further comprising a supporting device arranged at a lower end of the bed body, wherein the supporting device comprises a lifting device connected to the bed body and a supporting leg provided at a bottom potion of the lifting device, and the lifting device is configured to adjust a height of the bed body relative to ground.

* * * * *